US007306191B1

(12) United States Patent
Chen

(10) Patent No.: US 7,306,191 B1
(45) Date of Patent: Dec. 11, 2007

(54) SUSPENSION STRUCTURE FOR A CEILING FAN

(76) Inventor: Bi-Ju Chen, 2F, No. 3, Lane 20, Sec. 2, Ren-ai Rd., Jhongjheng District, Taipei City 100 (TW)

( * ) Notice: Subject to any disclaimer, the term of this patent is extended or adjusted under 35 U.S.C. 154(b) by 0 days.

(21) Appl. No.: 11/514,351

(22) Filed: Sep. 1, 2006

(51) Int. Cl.
*A47B 96/06* (2006.01)
*E04G 3/00* (2006.01)
*F16B 1/00* (2006.01)
*G09F 7/18* (2006.01)

(52) U.S. Cl. ..... 248/228.7; 248/223.41; 248/225.11; 248/220.22; 248/228.1; 248/300; 248/317

(58) Field of Classification Search ..... 248/223.41, 248/225.11, 220.22, 228.1, 228.7, 317, 300; 174/480–481, 50, 54, 58, 61–63; 52/713
See application file for complete search history.

(56) References Cited

U.S. PATENT DOCUMENTS 4,271,751 A * 6/1981 Timmons ..... 454/292
4,634,345 A * 1/1987 Stanek et al. ..... 416/244 R
4,811,475 A * 3/1989 Morton, Jr. ..... 29/521
4,847,733 A * 7/1989 Roy et al. ..... 361/825
4,923,163 A * 5/1990 Harley ..... 248/300
4,953,818 A * 9/1990 Contant ..... 248/222.52
5,090,654 A * 2/1992 Ridings et al. ..... 248/343
5,154,385 A * 10/1992 Lindberg et al. ..... 248/225.11
5,762,223 A * 6/1998 Kerr, Jr. ..... 220/3.9
6,203,279 B1 * 3/2001 Moody et al. ..... 416/244 R
6,360,507 B1 * 3/2002 Nevers et al. ..... 52/506.07
6,378,825 B1 * 4/2002 Yee et al. ..... 248/221.11
6,509,524 B1 * 1/2003 Gretz ..... 174/50
6,734,356 B1 * 5/2004 Gretz ..... 174/58
6,761,540 B2 * 7/2004 Tseng ..... 416/244 R
6,794,573 B1 * 9/2004 Ofcharsky et al. ..... 174/58
6,877,703 B2 * 4/2005 Tang ..... 248/342
6,981,678 B2 * 1/2006 Fu-Liang ..... 248/343
7,021,879 B2 * 4/2006 Taneichi ..... 411/466
7,028,963 B1 * 4/2006 Silva et al. ..... 248/342

* cited by examiner

*Primary Examiner*—Carl D. Friedman
*Assistant Examiner*—Michael McDuffie
(74) *Attorney, Agent, or Firm*—Troxell Law Office, PLLC

(57) ABSTRACT

A suspension structure for a ceiling fan is primarily composed of an L-shape plastic seat and a bracket, wherein by abutting a right-angle inner surface of the L-shape plastic seat on a right-angle portion of a beam, and then by transfixing screws into the bracket and the L-shape plastic seat to fix the seat under the beam, the bracket can be used to hang a ceiling fan. The L-shape plastic seat can be temporarily fixed under the beam conveniently, by the thorns of L-shape locking device, so as to facilitate the assembling and to enhance a structural intensity.

2 Claims, 5 Drawing Sheets

SUSPENSION STRUCTURE FOR A CEILING FAN

BACKGROUND OF THE INVENTION (a) Field of the Invention

The present invention relates to a suspension structure for a ceiling fan, and more particularly to a suspension structure for a ceiling fan which can be directly fixed under a beam to hang the ceiling fan, can be conveniently assembled, and is provided with an enhanced structural intensity.

(b) Description of the Prior Art

There are many kinds of conventional suspension structures for ceiling fans, with one kind among them being primarily composed of an L-shape plastic seat a and a bracket b (as shown in FIG. 5). After a right-angle inner surface of the L-shape plastic seat a is abutted on a right-angle portion of a beam c, and then the L-shape plastic seat a is fixed under a beam c by transfixing screws d into the bracket b and the L-shape plastic seat a, the bracket b can be used to hang a ceiling fan e. For this conventional suspension structure for the ceiling fan, the right-angle inner surface of L-shape plastic seat a is tightly abutted on the right-angle portion of beam c, so as to prevent the bracket b from getting loose or fallen off by a torsion force or swing resulted when the ceiling fan e is rotating, for assuring a safety of using the ceiling fan.

However, as the conventional L-shape plastic seat a is made by a plastic material and is without any reinforcement device, it breaks very easily at an intersection of right angles, so that a practicability of product is affected. In addition, in assembling the conventional L-shape plastic seat a, it cannot be fixed temporarily in advance; therefore, an inconvenience in assembling will be resulted and an overall stability will be inferior. Accordingly, it is necessary to improve the aforementioned conventional structure.

SUMMARY OF THE INVENTION

The primary object of present invention is to provide a suspension structure for a ceiling fan which is provided with a simple structure, can be conveniently assembled, and is provided with a structural intensity for assisting an L-shape plastic seat.

In order to achieve the aforementioned object, the suspension structure for a ceiling fan of present invention, includes primarily an L-shape plastic seat and a bracket, wherein by abutting a right-angle inner surface of the L-shape plastic seat on a corner portion of a beam, and then by transfixing screws into the bracket and the L-shape plastic seat, so as to fix the seat under the beam, the bracket can be used to hang the ceiling fan. The right-angle inner surface of L-shape plastic seat is provided with an L-shape locking device, a right-angle horizontal plane of the L-shape plastic seat is provided with a gliding slot, and a vertical plane of the L-shape plastic seat is provided with a groove which is extended upward along the gliding slot. The L-shape locking device is a metallic member formed integrally, which can be inserted through the gliding slot of L-shape plastic seat to be assembled with the seat into one body, and its horizontal arm and an end part of an inner surface of its vertical arm are provided with a plurality of thorns, respectively.

In assembling according to the aforementioned structures, the L-shape locking device is first inserted and assembled through the gliding slot of L-shape plastic seat, and next the thorns on the horizontal arm of L-shape locking device are snapped into the beam from bottom to top, then the L-shape plastic seat will be conveniently fixed under the beam temporarily, so as to facilitate a subsequent work of assembling the bracket and to enhance a structural intensity of the L-shape plastic seat by hooking the thorns of L-shape locking device into the beam.

Furthermore, an inner end of the gliding slot of L-shape plastic seat is provided with a lump, and an open cut is formed at a place close to a corner of the vertical arm of L-shape locking device to constitute a lever which is exactly corresponding to the aforementioned lump of gliding slot after the L-shape locking device is assembled with the L-shape plastic seat. Accordingly, in assembling, the L-shape plastic seat is pulled back to enable the lever to be lifted by the lump, such that the thorns on the vertical arm can be snapped into the beam more deeply to be fixed, thereby further achieving an object of enhancing the structural intensity.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
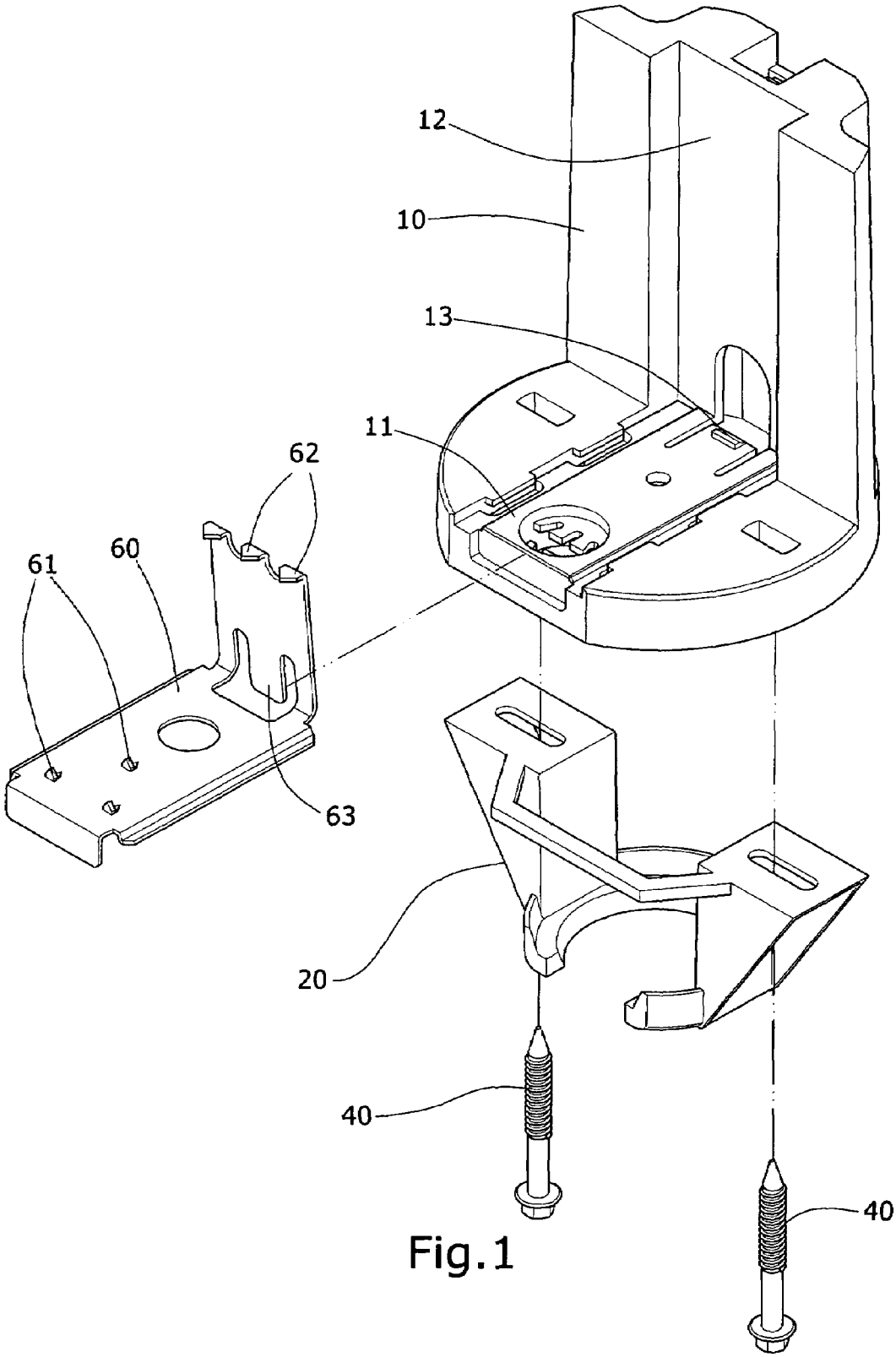
FIG. 1 shows an exploded view of the present invention.
Figure 2:
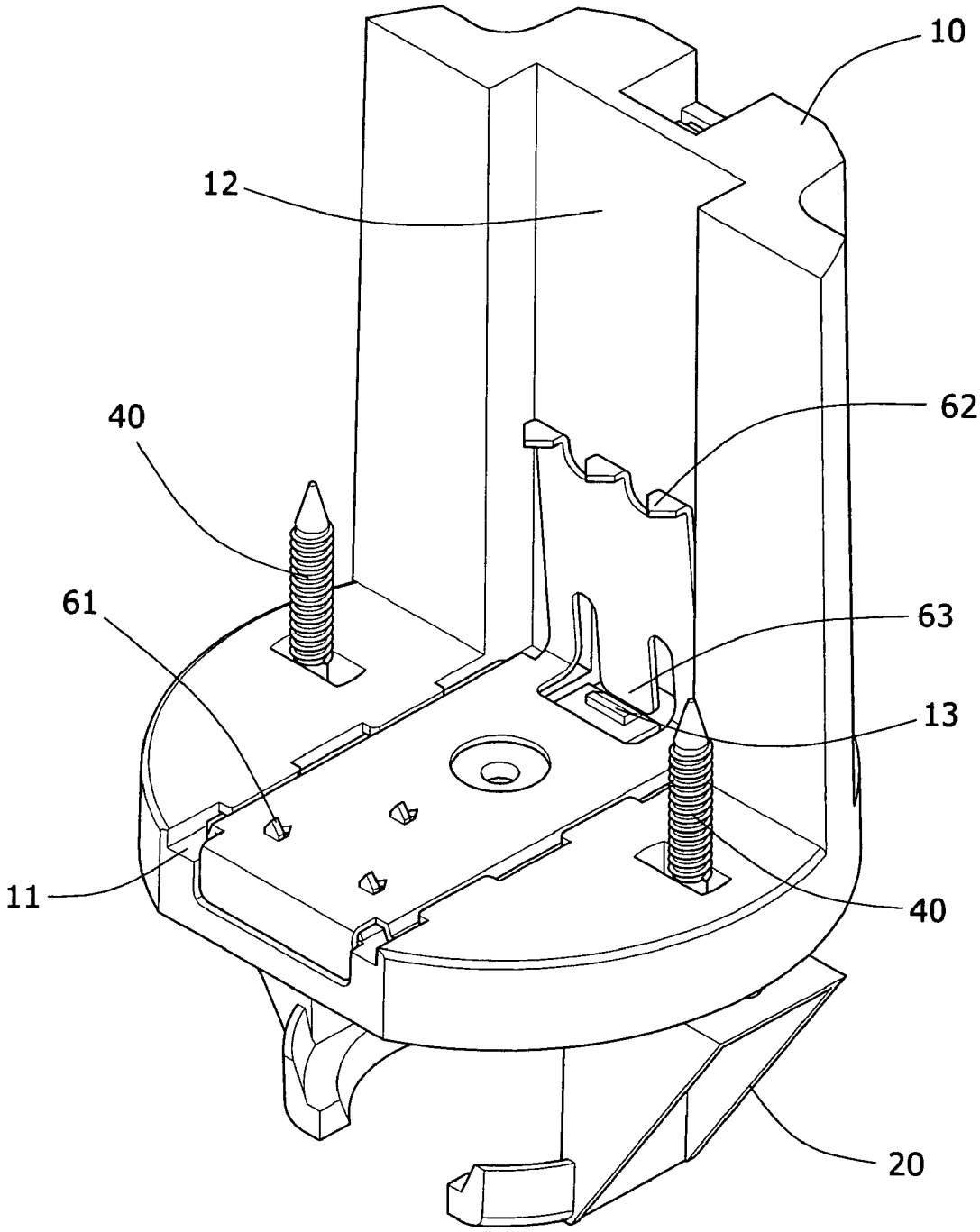
FIG. 2 shows a perspective view of the present invention.
Figure 3:
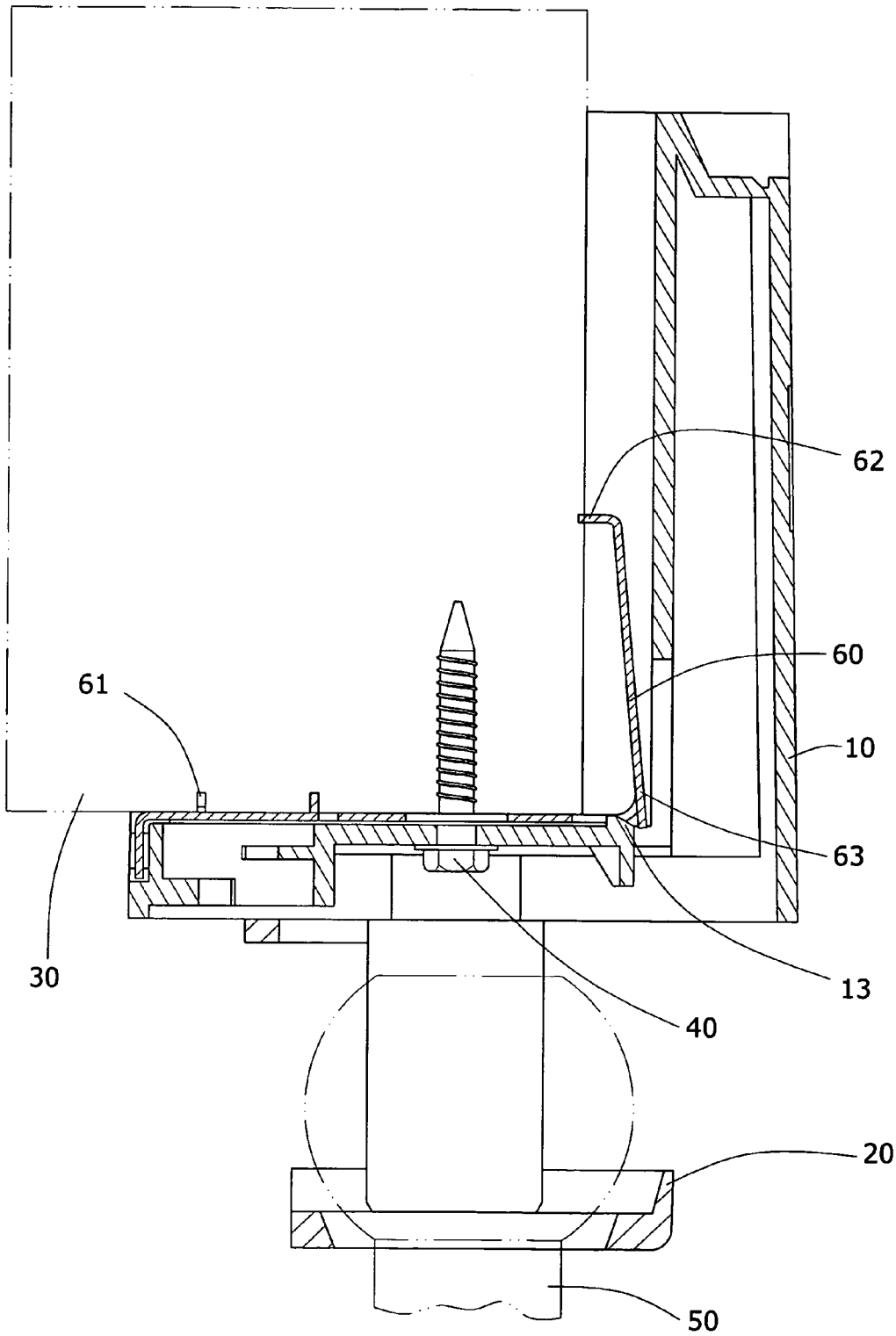
FIG. 3 shows a cutaway view of an embodiment of the present invention.

Referring to FIGS. 1 to 3, a suspension structure for a ceiling fan of the present invention comprises primarily an L-shape plastic seat 10 and a bracket 20, wherein by abutting a right-angle inner surface of the L-shape plastic seat 10 on a corner portion of a beam 30, and then by transfixing screws 40 into the bracket 20 and the L-shape plastic seat 10 to fix the seat 10 under the beam 30, the bracket 20 after being assembled can be used to hang a ceiling fan 50. The right-angle inner surface of L-shape plastic seat 10 is provided with an L-shape locking device 60, a right-angle horizontal plane of the L-shape plastic seat 10 is provided with a gliding slot 11, and a vertical plane of the L-shape plastic seat 10 is provided with a groove 12 which is extended upward along the gliding slot 11. The L-shape locking device 60 is a metallic member which is formed integrally, and can be inserted through the gliding slot 11 of L-shape plastic seat 10, such that a vertical arm of L-shape locking device 60 can be concaved into the groove 12 to be assembled with the L-shape plastic seat 10 into one body. In addition, a horizontal arm and an end part at an inner surface of the vertical arm of L-shape locking device 60 are provided with a plurality of thorns 61, 62 respectively.

In assembling and using the aforementioned structures, the L-shape locking device 60 is first inserted and assembled through the gliding slot 11 of L-shape plastic seat 10, and next the thorns 61 on the horizontal arm of L-shape locking device 60 are snapped into the beam 30 from bottom to top (as shown in FIG. 3), then the L-shape plastic seat 10 will be conveniently fixed under the beam 30 temporarily, so as to facilitate a subsequent work of assembling the bracket 20 and to enhance a structural intensity of the L-shape plastic seat 10 by hooking the thorns 61, 62 on the horizontal arm and vertical arm of L-shape locking device 60 into the beam 30.

Figure 4:
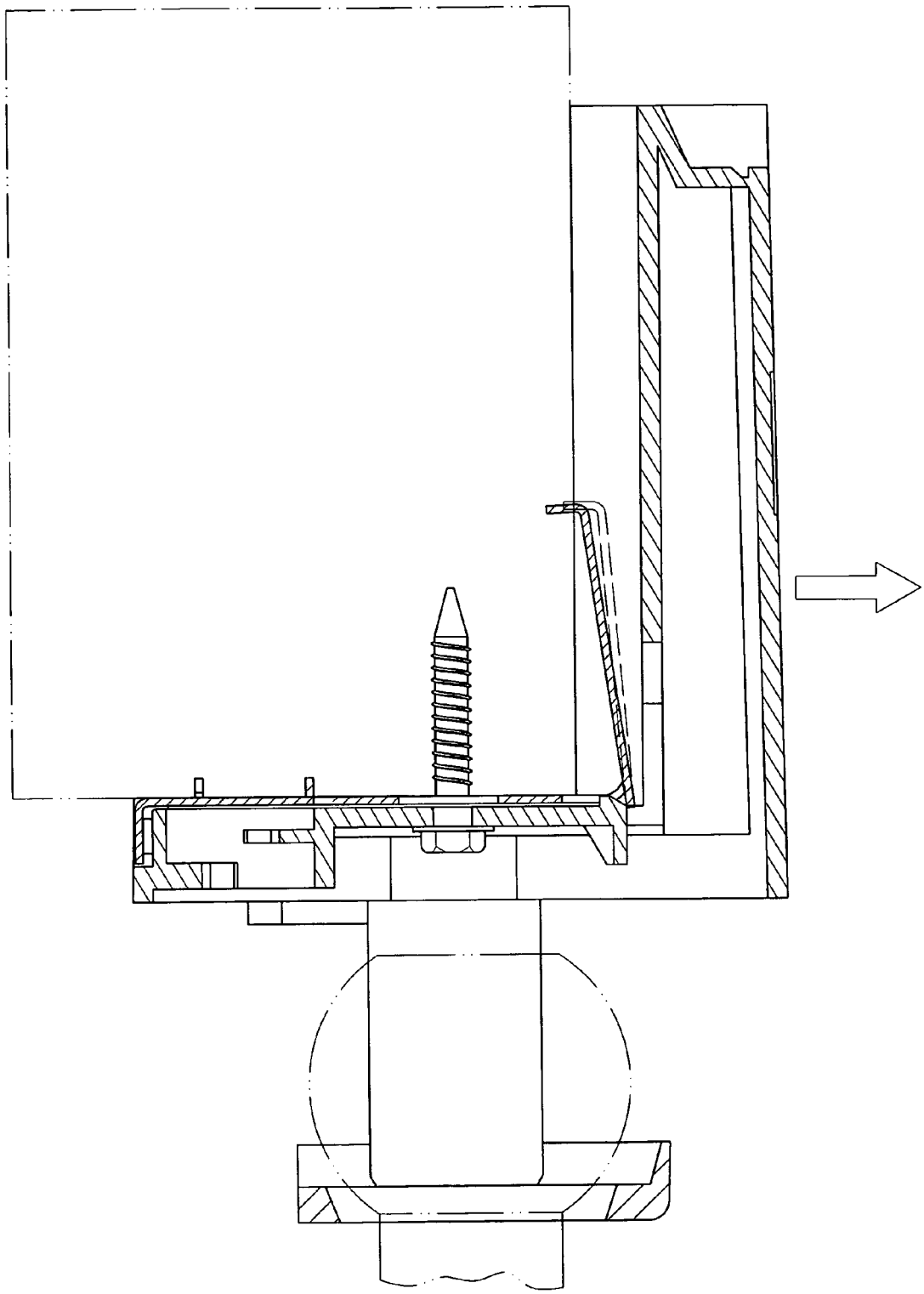
FIG. 4 shows a schematic view of an L-shape plastic seat which is moved back, as in FIG. 3.
Figure 5:
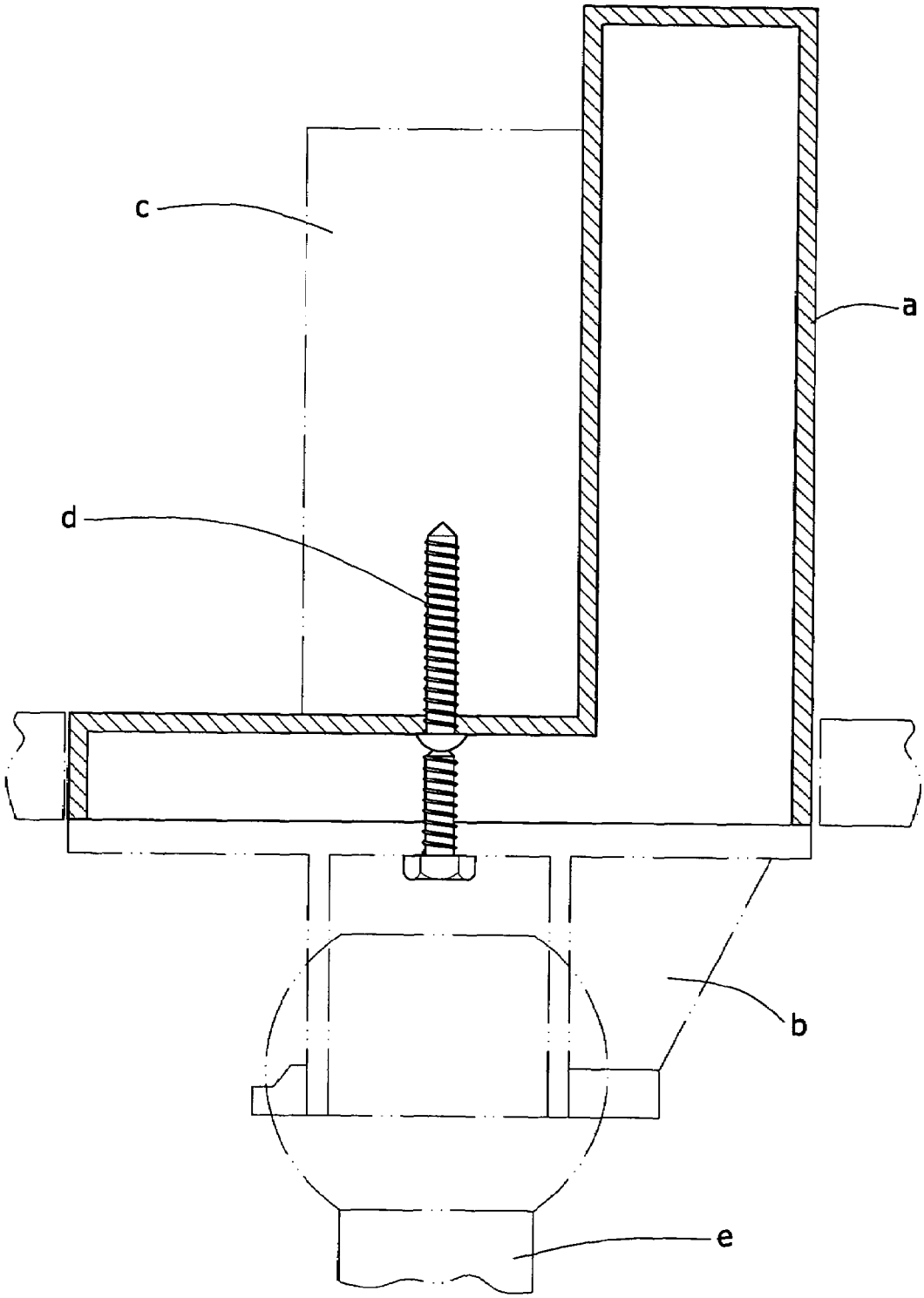
Fig.5(PRIOR ART)
FIG. 5 shows a schematic view of a conventional suspension structure for a ceiling fan.

Referring to FIG. 1 and FIG. 4, an inner end of the gliding slot 11 of L-shape plastic seat 10 is provided with a lump 13, and an open cut is formed at a place close to a corner of the vertical arm of L-shape locking device 60 to constitute a lever 63 which is exactly corresponding to a rear side of the aforementioned lump 13 of gliding slot 11 after the L-shape locking device 60 is assembled with the L-shape plastic seat 10. Accordingly, in implementing the present invention, the L-shape plastic seat 10 can be further pulled back to enable the lever 63 to be lifted by the lump 13, such that the thorns 62 on the vertical arm can be snapped into the beam 30 more deeply to be fixed, thereby further achieving an object of enhancing the structural intensity of L-shape plastic seat 10.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A suspension structure for a ceiling fan comprising an L-shape plastic seat and a bracket, wherein by abutting a right-angle inner surface of the L-shape plastic seat on a corner of a beam, and then by transfixing screws into the bracket and the L-shape plastic seat to fix the seat under the beam, a ceiling fan is hung by the bracket; the right-angle inner surface of L-shape plastic seat being provided with an L-shape locking device, a right-angle horizontal plane of the L-shape plastic seat being provided with a gliding slot, and a vertical plane being provided with a groove which is extended upward along the gliding slot; the L-shape locking device being a metallic member which is formed integrally, and being inserted through the gliding slot of L-shape plastic seat to be assembled with the L-shape plastic seat into one body, and a horizontal arm and an end part at an inner surface of a vertical arm of the L-shape locking device being provided with a plurality of thorns, respectively.

2. The suspension structure for a ceiling fan according to claim 1, wherein an inner end of the gliding slot of L-shape plastic seat is provided with a lump, and an open cut is formed at a place close to a corner of the vertical arm of L-shape locking device to constitute a lever which is exactly corresponding to the aforementioned lump of gliding slot after the L-shape locking device is assembled with the L-shape plastic seat.

* * * * *